US012644631B2

(12) United States Patent
Miura et al.

(10) Patent No.: US 12,644,631 B2
(45) Date of Patent: Jun. 2, 2026

(54) ROTARY COMPRESSOR AND REFRIGERATION CYCLE DEVICE

(71) Applicant: Carrier Japan Corporation, Tokyo (JP)

(72) Inventors: Ken Miura, Fuji (JP); Akira Iuchi, Fuji (JP); Napat Mothaneeyachart, Fuji (JP)

(73) Assignee: Carrier Japan Corporation, Tokyo (JP)

( * ) Notice: Subject to any disclaimer, the term of this patent is extended or adjusted under 35 U.S.C. 154(b) by 90 days.

(21) Appl. No.: 18/177,219

(22) Filed: Mar. 2, 2023

(65) Prior Publication Data

US 2023/0204267 A1 Jun. 29, 2023

Related U.S. Application Data

(63) Continuation of application No. PCT/JP2020/034831, filed on Sep. 15, 2020.

(51) Int. Cl.
*F25B 41/26* (2021.01)
*F25B 49/02* (2006.01)

(52) U.S. Cl.
CPC ..... *F25B 41/26* (2021.01); *F25B 49/02* (2013.01); *F25B 2313/0253* (2013.01); *F25B 2600/2507* (2013.01)

(58) Field of Classification Search
CPC .... F25B 2313/0292; F25B 2313/02742; F25B 41/26; F25B 49/02; F25B 2313/0253;
(Continued)

(56) References Cited

U.S. PATENT DOCUMENTS

2005/0193748 A1 9/2005 Hwang et al.
2022/0120485 A1* 4/2022 Yamaguchi ..... F25B 49/005

FOREIGN PATENT DOCUMENTS

CN 101504236 A 8/2009
CN 105509257 A * 4/2016 ..... F24F 11/30
(Continued)

OTHER PUBLICATIONS

International Search Report issued Nov. 2, 2020 in PCT/JP2020/034831 filed on Sep. 15, 2020, 5 pages (with English Translation).
(Continued)

*Primary Examiner* — Tavia Sullens
(74) *Attorney, Agent, or Firm* — Oblon, McClelland, Maier & Neustadt, L.L.P.

(57) ABSTRACT

A refrigeration cycle device of the embodiment includes an indoor unit, a first outdoor unit and a second outdoor unit, and a control unit. The second outdoor unit includes a four-way valve. The four-way valve includes a main valve having a main valve body and a sub-valve having a sub-valve body. The main valve body is movable between a first position and a second position. The sub-valve body is driven by a solenoid and is movable between a third position and a fourth position. In case in which the first outdoor unit is operated and the second outdoor unit is stopped, when the main valve body is not at the first position, the control unit disposes the sub-valve body at the fourth position and then moves the sub-valve body to the third position.

6 Claims, 7 Drawing Sheets

(58) Field of Classification Search
CPC ..... F25B 2600/2507; F25B 2313/0233; F25B 2700/1931; F25B 2700/1933; F25B 13/00; F25B 5/02; F25B 6/02
See application file for complete search history.

(56) References Cited

FOREIGN PATENT DOCUMENTS

| | | | |
|---|---|---|---|
| EP | 1 179 714 | A2 | 2/2002 |
| EP | 1 965 159 | A1 | 9/2008 |
| EP | 2 192 361 | A1 | 6/2010 |
| EP | 3 315 877 | A1 | 5/2018 |
| JP | 8-200868 | A | 8/1996 |
| JP | 11-108472 | A | 4/1999 |
| JP | 2009-144967 | A | 7/2009 |
| JP | 2010-48506 | A | 3/2010 |
| JP | 2018-194037 | A | 12/2018 |
| JP | 2002-340386 | A | 11/2022 |
| WO | WO 2017/068902 | A1 | 4/2017 |

OTHER PUBLICATIONS

Extended European Search Report issued Apr. 29, 2024 in European Application No. 20954040.0, 8 pgs.
Combined Office Action and Search Report issued in Chinese Patent Application No. 202080104110.6 on Jan. 29, 2026, with English Translation of the Search Report, citing documents 1-2 therein.

* cited by examiner

ROTARY COMPRESSOR AND REFRIGERATION CYCLE DEVICE

CROSS-REFERENCE TO RELATED APPLICATIONS

This is a Continuation application of International Application No. PCT/JP2020/034831, filed on Sep. 15, 2020; the entire contents of which are incorporated herein by reference.

FIELD

Embodiments described herein relate generally to a refrigeration cycle device.

BACKGROUND

A refrigeration cycle device of a multi-air conditioning system includes an indoor unit having an indoor heat exchanger, and a plurality of outdoor units connected in parallel to the indoor unit. The outdoor unit includes a compressor, an outdoor heat exchanger, and a four-way valve. The four-way valve switches a supply destination of a refrigerant discharged from the compressor between the indoor heat exchanger and the outdoor heat exchanger.

Of the plurality of outdoor units, there are cases in which only some of the outdoor units are operated and the rest of the outdoor units are stopped. A switching failure of the four-way valve may occur in an outdoor unit that is stopped. It is required to eliminate a switching failure of the four-way valve in an outdoor unit that is stopped.

DETAILED DESCRIPTION

A refrigeration cycle device of the embodiment includes an indoor unit, a first outdoor unit and a second outdoor unit, and a control unit. The indoor unit includes an indoor heat exchanger. The first outdoor unit and the second outdoor unit are connected in parallel to the indoor unit. The second outdoor unit includes a compressor, an outdoor heat exchanger, and a four-way valve. The four-way valve switches a supply destination of a refrigerant discharged from the compressor between the indoor heat exchanger and the outdoor heat exchanger. The four-way valve includes a main valve having a main valve body and a sub-valve having a sub-valve body. The main valve body is movable between a first position and a second position. The first position is a position that allows the refrigerant discharged from the compressor to be supplied to one of the indoor heat exchanger and the outdoor heat exchanger. The second position is a position that allows the refrigerant discharged from the compressor to be supplied to the other of the indoor heat exchanger and the outdoor heat exchanger. The sub-valve body is driven by a solenoid and is movable between a third position and a fourth position. The third position is a position that causes the main valve body to be disposed at the first position. The fourth position is a position that causes the main valve body to be disposed at the second position. In case in which the first outdoor unit is operated and the second outdoor unit is stopped, when the main valve body is not at the first position, the control unit disposes the sub-valve body at the fourth position and then moves the sub-valve body to the third position.

Hereinafter, a refrigeration cycle device according to an embodiment will be described with reference to the drawings.

Figure 1:
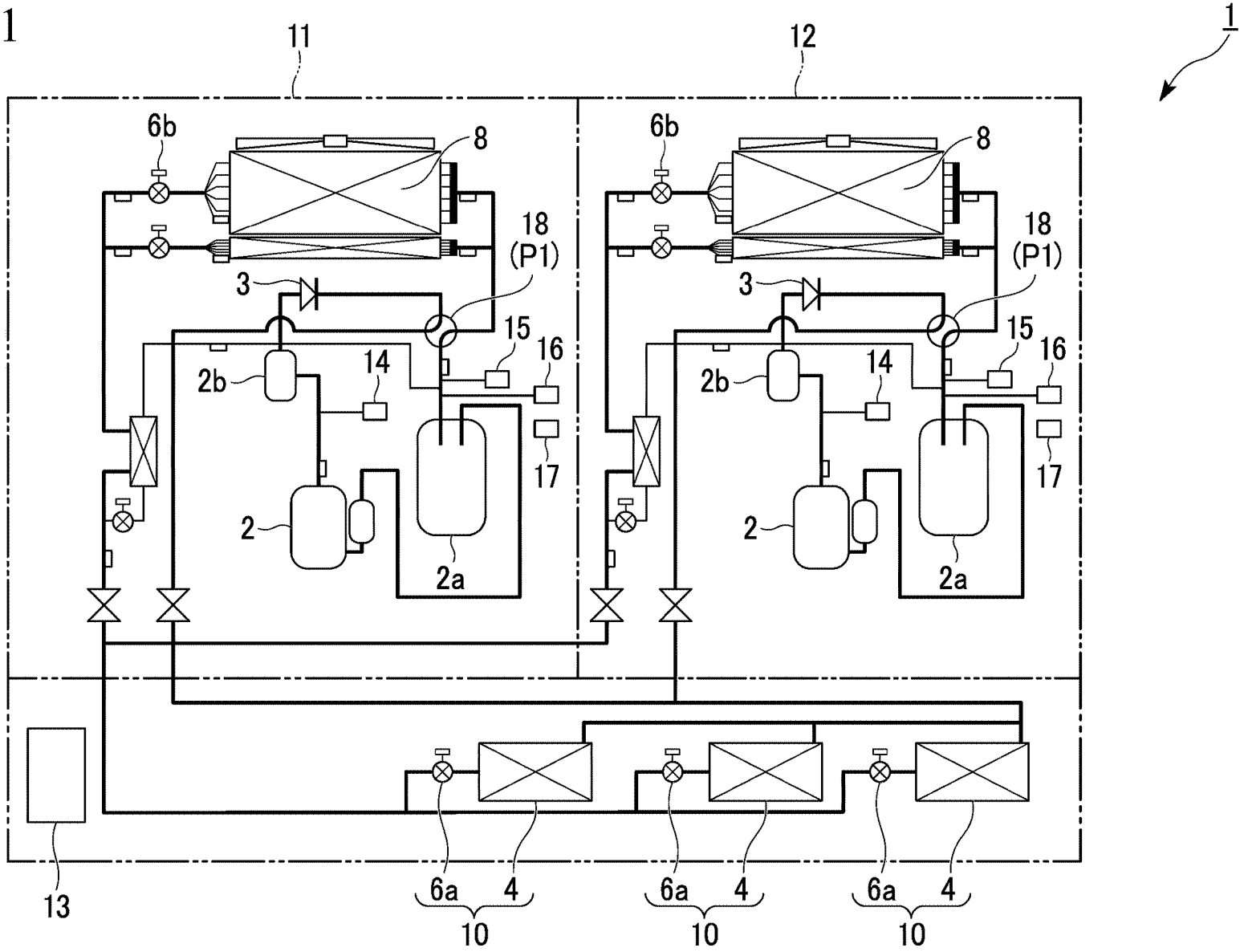
FIG. 1 is a schematic configuration view and a first operation explanatory view of a refrigeration cycle device according to an embodiment.

FIG. 1 is a schematic configuration view and a first operation explanatory view of a refrigeration cycle device according to an embodiment. A refrigeration cycle device 1 includes a plurality of indoor units 10, a plurality of outdoor units 11 and 12, and a refrigerant flow path that allows a refrigerant to flow through them. The refrigeration cycle device 1 contains a refrigerant such as R410A, R32, R454B, R466A, or carbon dioxide ($CO_2$). The refrigerant circulates in the refrigeration cycle device 1 while changing its phase.

The plurality of indoor units 10 are connected in parallel to the plurality of outdoor units 11 and 12. The indoor units 10 each include an indoor heat exchanger 4 and an indoor expansion valve 6*a*.

The plurality of outdoor units 11 and 12 are connected in parallel to the plurality of indoor units 10. The plurality of outdoor units 11 and 12 include a first outdoor unit 11 and a second outdoor unit 12. The plurality of outdoor units 11 and 12 may include three or more outdoor units. The first outdoor unit 11 includes a compressor 2, a four-way valve 18, an outdoor heat exchanger 8, and an outdoor expansion valve 6*b*. The second outdoor unit 12 is configured similarly to the first outdoor unit 11. Hereinafter, the compressor 2 of the first outdoor unit 11 may be referred to as a first compressor 2, and the compressor 2 of the second outdoor unit 12 may be referred to as a second compressor 2. Also, the four-way valve 18 of the first outdoor unit 11 may be referred to as a first four-way valve 18, and the four-way valve 18 of the second outdoor unit 12 may be referred to as a second four-way valve 18.

The four-way valve 18 switches a supply destination of the refrigerant discharged from the compressor 2 between the indoor heat exchanger 4 and the outdoor heat exchanger 8. When the refrigeration cycle device 1 performs an indoor heating operation, the refrigerant discharged from the compressor 2 is supplied to the indoor heat exchanger 4. When the refrigeration cycle device 1 performs an indoor cooling operation or a defrosting operation of the outdoor heat exchanger 8, the refrigerant discharged from the compressor 2 is supplied to the outdoor heat exchanger 8. In the example of FIG. 1, the four-way valve 18 is switched so that the refrigeration cycle device 1 performs a heating operation.

A case in which the refrigeration cycle device 1 performs a heating operation will be described.

The compressor 2 compresses a low-pressure gaseous refrigerant (fluid) taken into the inside into a high-temperature and high-pressure gaseous refrigerant. The refrigerant discharged from the compressor 2 is supplied to the four-way valve 18 via an oil separator 2*b* and a check valve 3.

When the refrigeration cycle device 1 performs a heating operation, the refrigerant is supplied from the four-way valve 18 to the indoor heat exchanger 4 of the indoor unit 10.

The indoor heat exchanger 4 functions as a condenser (radiator). The condenser dissipates heat from a high-temperature and high-pressure gaseous refrigerant discharged from the compressor 2 to convert the high-temperature and high-pressure gaseous refrigerant into a high-pressure liquid refrigerant. The refrigerant discharged from the indoor heat exchanger 4 flows through the indoor expansion valve 6*a* and the outdoor expansion valve 6*b*.

The indoor expansion valve 6*a* and the outdoor expansion valve 6*b* reduce a pressure of the high-pressure liquid refrigerant supplied from the indoor heat exchanger 4 and convert the high-pressure liquid refrigerant into a low-temperature and low-pressure gas-liquid two-phase refrigerant. The refrigerant discharged from the outdoor expansion valve 6*b* is supplied to the outdoor heat exchanger 8.

The outdoor heat exchanger 8 functions as an evaporator (heat absorber). The evaporator converts the gas-liquid two-phase refrigerant discharged from the outdoor expansion valve 6*b* into a low-pressure gaseous refrigerant. The refrigerant discharged from the outdoor heat exchanger 8 is supplied to the four-way valve 18. The refrigerant discharged from the four-way valve 18 is supplied to the compressor 2 via an accumulator (gas-liquid separator) 2*a*.

When the refrigeration cycle device 1 performs a cooling operation or a defrosting operation, the four-way valve 18 switches from the state illustrated in FIG. 1. In this case, the refrigerant discharged from the compressor 2 flows through the four-way valve 18, the outdoor heat exchanger 8, the outdoor expansion valve 6*b*, the indoor expansion valve 6*a*, the indoor heat exchanger 4, the four-way valve 18, and the compressor 2 in that order. In this case, the outdoor heat exchanger 8 functions as a condenser (radiator), and the indoor heat exchanger 4 functions as an evaporator (heat absorber).

The refrigeration cycle device 1 includes a discharge pressure sensor 14, a suction pressure sensor 15, a suction temperature sensor 16, and an outside air temperature sensor 17. The discharge pressure sensor 14 is disposed on a refrigerant flow path between a discharge port of the compressor 2 and the four-way valve 18. The discharge pressure sensor 14 outputs a discharge pressure signal corresponding to a discharge pressure of the refrigerant due to the compressor 2. The suction pressure sensor 15 and the suction temperature sensor 16 are disposed on the refrigerant flow path between a suction port of the compressor 2 and the four-way valve 18. The suction pressure sensor 15 outputs a suction pressure signal corresponding to a suction pressure of the refrigerant due to the compressor 2. The suction temperature sensor 16 outputs a suction temperature signal corresponding to a temperature of the refrigerant suctioned into the compressor 2. The outside air temperature sensor 17 is disposed at a place in contact with outside air in the outdoor unit. The outside air temperature sensor 17 outputs an outside air temperature signal corresponding to an outside air temperature.

The refrigeration cycle device 1 includes a central processing unit (CPU), a memory, an auxiliary storage device, and the like. The CPU functions as a control unit 13 by executing a program stored in the memory and the auxiliary storage device. The control unit 13 controls an operation of each part of the refrigeration cycle device 1. The control unit 13 receives the discharge pressure signal, the suction pressure signal, the suction temperature signal, and the outside air temperature signal. The control unit 13 controls energization to a solenoid 31 of the four-way valve 18 to be described later.

A structure of the four-way valve 18 will be described in detail.

Figure 2:
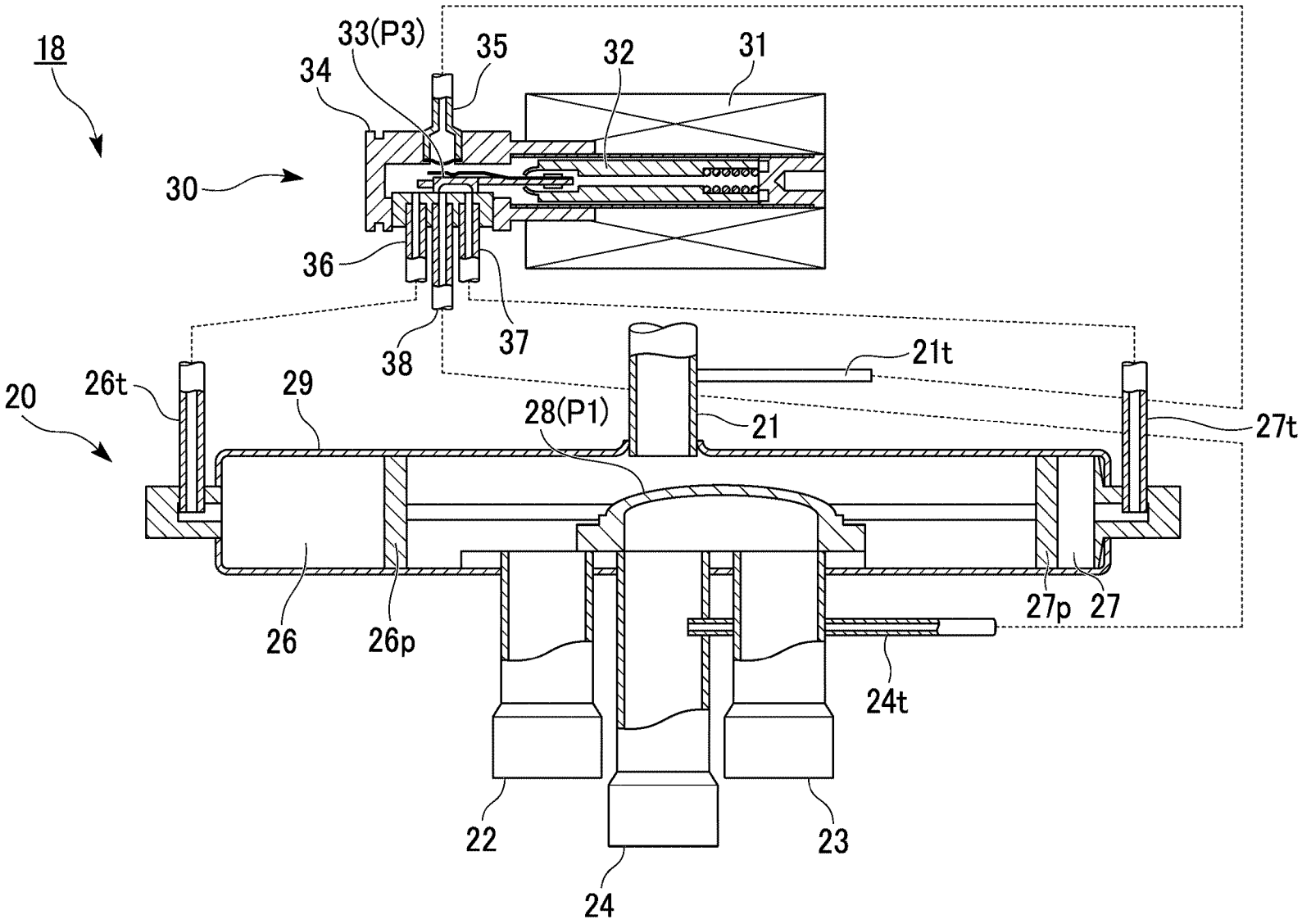
FIG. 2 is a schematic configuration view and a first operation explanatory view of a four-way valve.
Figure 3:
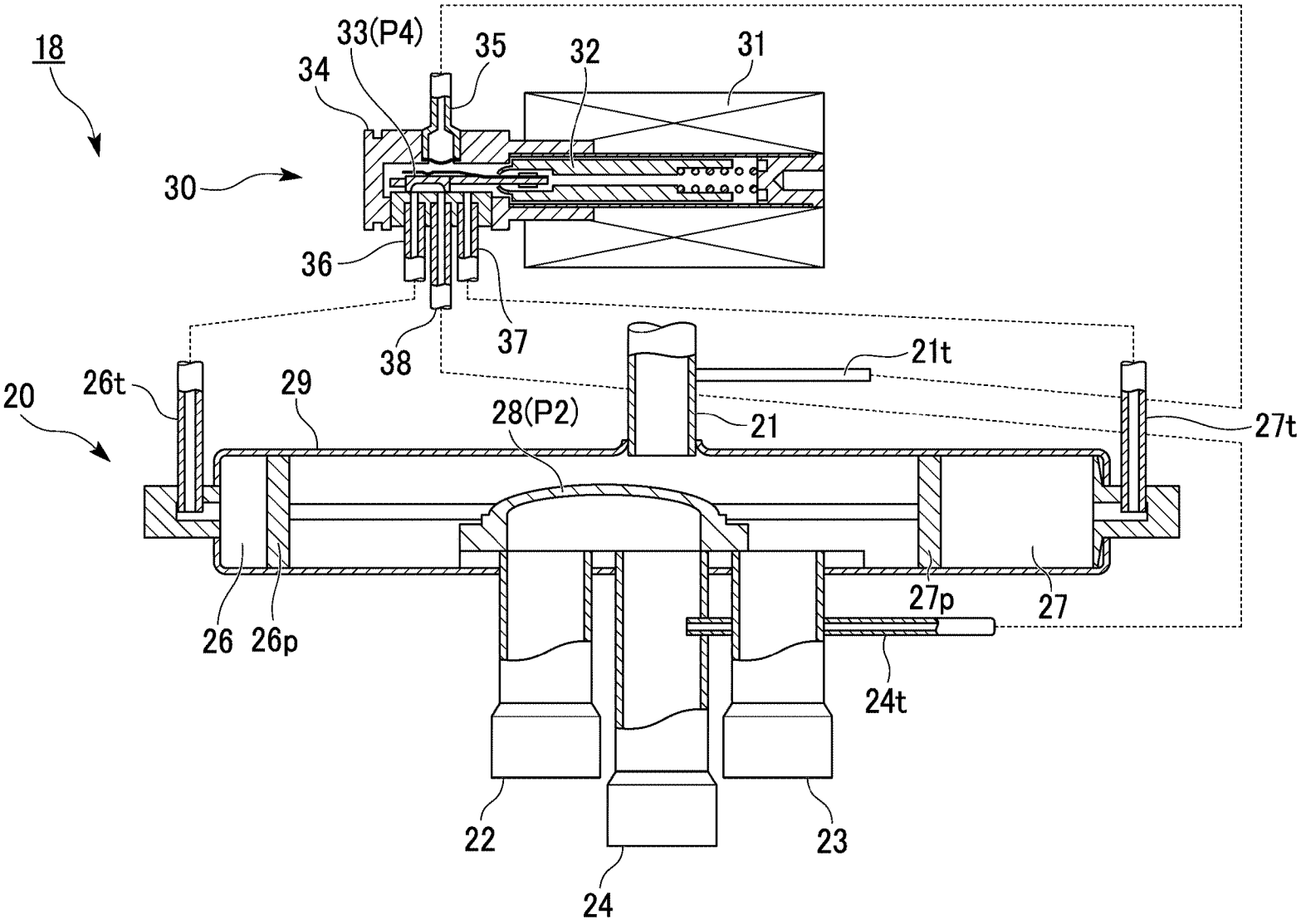
FIG. 3 is a second operation explanatory view of the four-way valve.

FIG. 2 is a schematic configuration view and a first operation explanatory view of the four-way valve. FIG. 3 is a second operation explanatory view of the four-way valve. FIG. 2 illustrates a state of the four-way valve 18 during a heating operation, and FIG. 3 illustrates a state of the four-way valve 18 during a cooling or defrosting operation. The four-way valve 18 includes a main valve 20 and a sub-valve (pilot valve) 30.

The main valve 20 includes a housing 29 and a main valve body 28.

The housing 29 is formed in a cylindrical shape. The housing 29 includes a first port 21, a second port 22, a third port 23, and a fourth port 24. The first port 21 is connected to the discharge port of the compressor 2. The second port 22 is connected to one of the indoor heat exchanger 4 and the outdoor heat exchanger 8. In the present embodiment, the second port 22 is connected to the indoor heat exchanger 4. The third port 23 is connected to the other of the indoor heat exchanger 4 and the outdoor heat exchanger 8. In the present embodiment, the third port 23 is connected to the outdoor heat exchanger 8. The fourth port 24 is connected to the suction port of the compressor 2. A connection destination of each port indicates which of the discharge port of the compressor 2, the suction port of the compressor 2, the indoor heat exchanger 4, and the outdoor heat exchanger 8 is connected initially. For example, the first port 21 is connected initially to the discharge port of the compressor 2 via the check valve 3 and the oil separator 2*b* illustrated in FIG. 1.

The main valve body 28 is disposed inside the housing 29 in the vicinity of a center in a longitudinal direction of the housing 29. The main valve body 28 is movable between a first position P1 and a second position P2 in the longitudinal direction of the housing 29.

In FIG. 2, the main valve body 28 is disposed at the first position P1. The main valve body 28 connects the first port 21 and the second port 22 when it is at the first position P1. The main valve body 28 supplies the refrigerant discharged from the compressor 2 to one of the indoor heat exchanger 4 and the outdoor heat exchanger 8 when it is at the first position P1. In the present embodiment, the refrigerant discharged from the compressor 2 is supplied to the indoor heat exchanger 4 through the first port 21 and the second port 22. The main valve body 28 connects the third port 23 and the fourth port 24 when it is at the first position P1. In the present embodiment, the refrigerant discharged from the outdoor heat exchanger 8 is supplied to the suction port of the compressor 2 through the third port 23 and the fourth port 24.

In FIG. 3, the main valve body 28 is disposed at the second position P2. The main valve body 28 connects the first port 21 and the third port 23 when it is at the second position P2. The main valve body 28 supplies the refrigerant discharged from the compressor 2 to one of the indoor heat exchanger 4 and the outdoor heat exchanger 8 when it is at the second position P2. In the present embodiment, the refrigerant discharged from the compressor 2 is supplied to the outdoor heat exchanger 8 through the first port 21 and the third port 23. The main valve body 28 connects the second port 22 and the fourth port 24 when it is at the second position P2. In the present embodiment, the refrigerant discharged from the indoor heat exchanger 4 is supplied to the suction port of the compressor 2 through the second port 22 and the fourth port 24.

The main valve 20 includes a first cylinder chamber 26 and a second cylinder chamber 27. The first cylinder chamber 26 is formed between one end portion of the housing 29 in the longitudinal direction and a first piston 26*p* disposed on one side of the main valve body 28. The second cylinder chamber 27 is formed between the other end portion of the housing 29 in the longitudinal direction and a second piston 27*p* disposed on the other side of the main valve body 28. The first piston 26*p* and the second piston 27*p* are connected to the main valve body 28. As illustrated in FIG. 2, when the first cylinder chamber 26 expands and the second cylinder chamber 27 contracts, the main valve body 28 is disposed at the first position P1. The first cylinder chamber 26 expands to move the main valve body 28 to the first position P1. As illustrated in FIG. 3, when the second cylinder chamber 27 expands and the first cylinder chamber 26 contracts, the main valve body 28 is disposed at the second position P2. The second cylinder chamber 27 expands to move the main valve body 28 to the second position P2. Hereinafter, the main valve body 28 of the four-way valve 18 being disposed at the first position P1 or the second position P2 may be simply referred to as the four-way valve 18 being disposed at the first position P1 or the second position P2.

The sub-valve 30 includes a housing 34 and a sub-valve body 33.

The housing 34 is formed in a cylindrical shape. The housing 34 includes a fifth port 35, a sixth port 36, a seventh port 37, and an eighth port 38. The fifth port 35 communicates with the first port 21 via a capillary 21*t*. The sixth port 36 is connected to the first cylinder chamber 26 via a capillary 26*t*. The seventh port 37 is connected to the second cylinder chamber 27 via a capillary 27*t*. The eighth port 38 communicates with the fourth port 24 via a capillary 24*t*.

The sub-valve body 33 is disposed inside the housing 34 in the vicinity of a center in a longitudinal direction of the housing 34. The sub-valve body 33 is movable between a third position P3 and a fourth position P4 in the longitudinal direction of the housing 34.

In FIG. 2, the sub-valve body 33 is disposed at the third position P3. The sub-valve body 33 connects the fifth port 35 and the sixth port 36 when it is at the third position P3. The high-pressure refrigerant discharged from the compressor 2 flows into the first cylinder chamber 26 via the first port 21, the capillary 21*t*, the fifth port 35, the sixth port 36, and the capillary 26*t*. The sub-valve body 33 connects the seventh port 37 and the eighth port 38 when it is at the third position P3. The refrigerant in the second cylinder chamber 27 flows into the suction port of the compressor 2 via the capillary 27*t*, the seventh port 37, the eighth port 38, the capillary 24*t*, and the fourth port. The first cylinder chamber 26 at a high pressure expands, the second cylinder chamber 27 at a low pressure contracts, and thereby the main valve body 28 is disposed at the first position P1. At the third position P3, the sub-valve body 33 disposes the main valve body 28 at the first position P1.

In FIG. 3, the sub-valve body 33 is disposed at the fourth position P4. The sub-valve body 33 connects the fifth port 35 and the seventh port 37 when it is at the fourth position P4. The high-pressure refrigerant discharged from the compressor 2 flows into the second cylinder chamber 27 via the first port 21, the capillary 21*t*, the fifth port 35, the seventh port 37, and the capillary 27*t*. The sub-valve body 33 connects the sixth port 36 and the eighth port 38 when it is at the fourth position P4. The refrigerant in the first cylinder chamber 26 flows into the suction port of the compressor 2 via the capillary 26*t*, the sixth port 36, the eighth port 38, the capillary 24*t*, and the fourth port 24. The second cylinder chamber 27 at a high pressure expands, the first cylinder chamber 26 at a low pressure contracts, and thereby the main valve body 28 is disposed at the second position P2. At the fourth position P4, the sub-valve body 33 disposes the main valve body 28 at the second position P2.

The sub-valve body 33 is connected to a plunger 32. The plunger 32 is driven by the solenoid 31 and is movable in the longitudinal direction. When the control unit 13 turns on energization to the solenoid 31, the sub-valve body 33 is disposed at the third position P3 as illustrated in FIG. 2. Thereby, the main valve body 28 is disposed at the first position P1, and the heating operation is performed. When the control unit 13 turns off energization to the solenoid 31, the sub-valve body 33 is disposed at the fourth position P4 as illustrated in FIG. 3. Thereby, the main valve body 28 is disposed at the second position P2, and the cooling or defrosting operation is performed.

The refrigeration cycle device 1 adjusts the number of the plurality of outdoor units to be operated on the basis of an indoor temperature and an outdoor temperature. Of the plurality of outdoor units, there are cases in which only some of the outdoor units are operated and the rest of the outdoor units are stopped. For example, in the heating operation, only the first outdoor unit 11 illustrated in FIG. 1 is operated, and the second outdoor unit 12 is stopped. In this case, energization to both the solenoids 31 of the first four-way valve 18 and the second four-way valve 18 is ON. Both the first four-way valve 18 and the second four-way valve 18 are at the first position P1. The high-pressure refrigerant discharged from the first compressor 2 enters not only the indoor unit 10 but also the second outdoor unit 12 that is in a stopped state. Since the second four-way valve 18 is at the first position P1, entrance of the high-pressure refrigerant is prevented by the check valve 3.

In the cooling operation, there are cases in which only the first outdoor unit 11 is operated and the second outdoor unit 12 is stopped. In this case, energization to both the solenoids 31 of the first four-way valve 18 and the second four-way valve 18 is OFF. Both the first four-way valve 18 and the second four-way valve 18 are at the second position P2. The low-pressure refrigerant discharged from the indoor unit 10 enters the second outdoor unit 12 in a stopped state.

When all of the plurality of outdoor units 11 and 12 are in a stopped state, energization to the solenoids 31 of the first four-way valve 18 and the second four-way valve 18 is OFF. The first four-way valve 18 and the second four-way valve 18 are at the second position P2.

Figure 4:
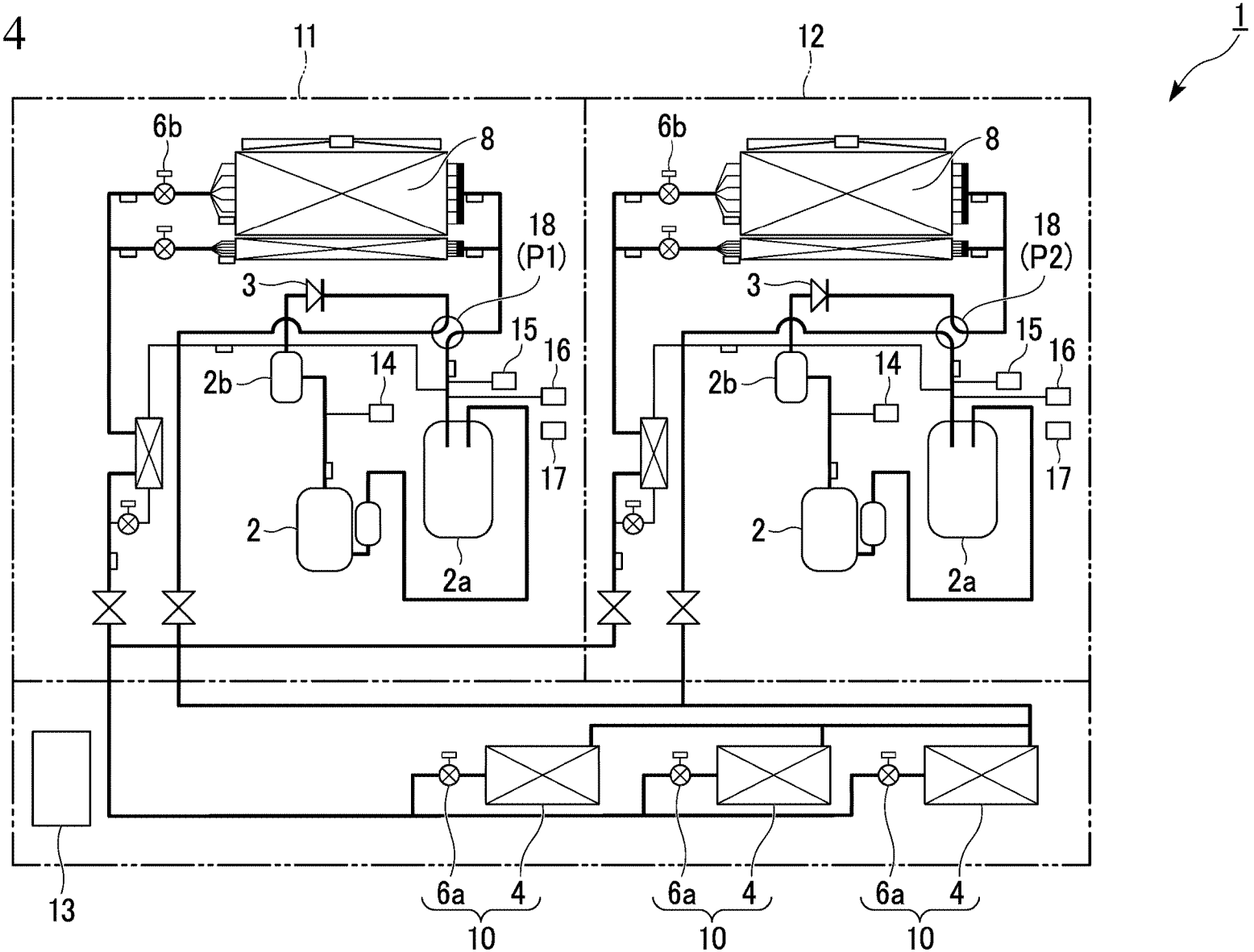
FIG. 4 is a second operation explanatory view of the refrigeration cycle device.
Figure 5:
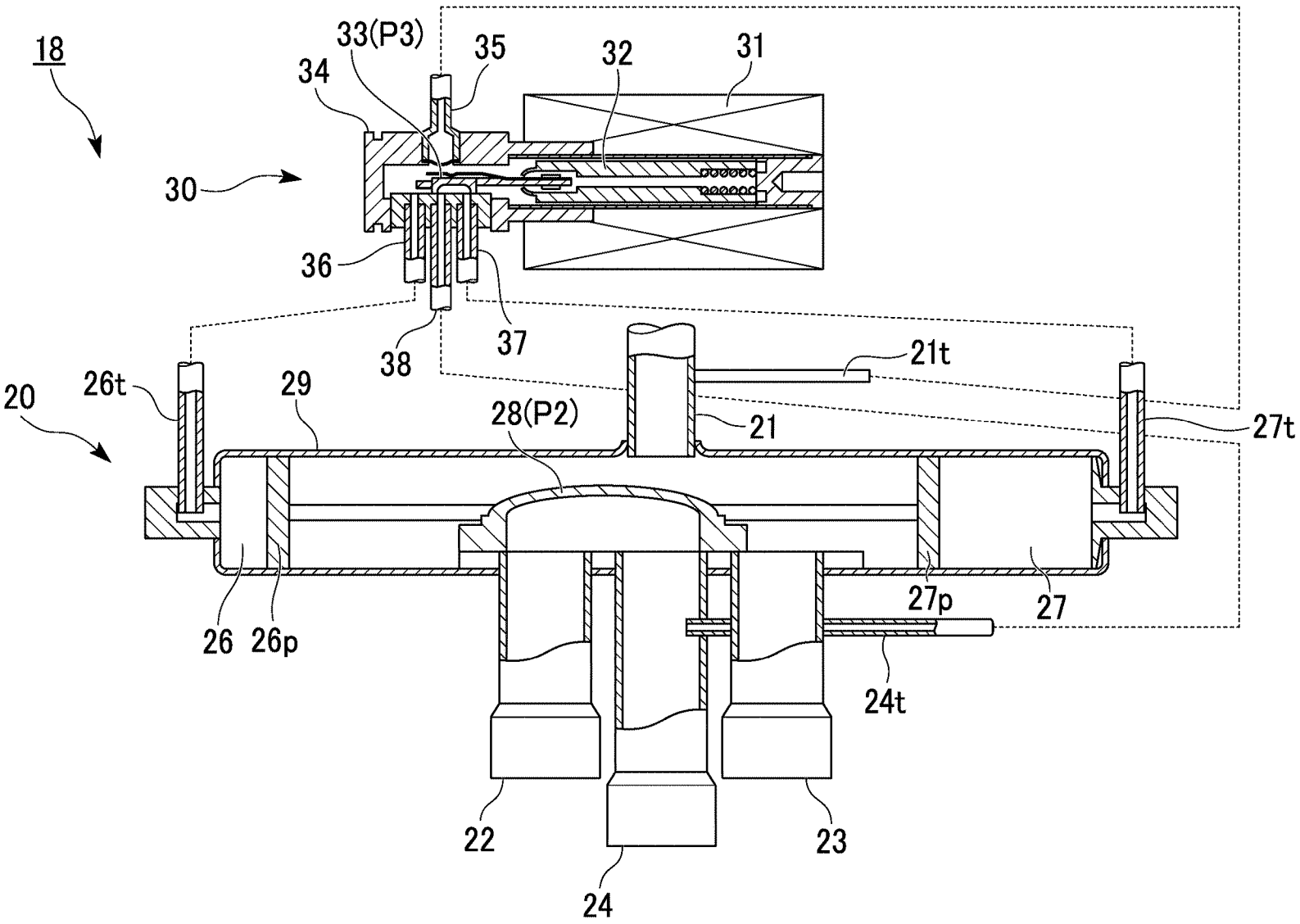
FIG. 5 is a third operation explanatory view of the four-way valve.

FIG. 4 is a second operation explanatory view of the refrigeration cycle device. FIG. 5 is a third operation explanatory view of the four-way valve. There are cases in which only the first outdoor unit 11 is operated for heating and the second outdoor unit 12 is stopped from a state in which all of the plurality of outdoor units 11 and 12 are stopped or in a defrosting operation. The control unit 13 turns on the solenoids of the first four-way valve 18 and the second four-way valve 18. As illustrated in FIG. 5, the main valve body 28 is still disposed at the second position P2 immediately after the sub-valve body 33 has moved to the third position P3.

A pressure difference between a discharge pressure of the first compressor 2 in operation and a discharge pressure of the second compressor 2 that is stopped may be large. When the second four-way valve 18 is at the second position P2, the high-pressure refrigerant discharged from the first compressor 2 flows from the second port 22 of the second four-way valve 18 into the fourth port 24. The high-pressure refrigerant flows into the second cylinder chamber 27 via the capillary 24*t*, the eighth port 38, the seventh port 37, and the capillary 27*t*. On the other hand, since the high-pressure refrigerant does not flow from the second compressor 2 into the first port 21, the first cylinder chamber 26 is at a low pressure. Thereby, the main valve body 28 of the second four-way valve 18 may not move to the first position P1. When the second four-way valve 18 is not at the first position P1, the second four-way valve 18 remains stopped at the second position P2 or stops after moving to an intermediate position between the second position P2 and the first position P1.

As described above, the high-pressure refrigerant discharged from the first compressor 2 in operation enters the second outdoor unit 12 in a stopped state. As illustrated in FIG. 4, when the second four-way valve 18 is not at the first position P1, the high-pressure refrigerant enters the suction port of the second compressor 2 from the second four-way valve 18 via the accumulator 2*a*. When the high-pressure refrigerant liquefies and stays in the second compressor 2 in a stopped state, a problem of refrigerant stagnation occurs. The refrigerant stagnation causes a failure in the second compressor 2 when the second compressor 2 is restarted.

The control unit 13 detects a switching failure of the second four-way valve 18 as follows. When the second four-way valve 18 is not at the first position P1, the high-pressure refrigerant discharged from the first compressor 2 enters the suction port of the second compressor 2. The control unit 13 receives a discharge pressure signal output from the discharge pressure sensor 14 of the first compressor 2. The control unit 13 receives a suction pressure signal output from the suction pressure sensor 15 of the second compressor 2. When a difference between the discharge pressure of the first compressor 2 and the suction pressure of the second compressor 2 is lower than a predetermined value, the control unit 13 determines that the second four-way valve 18 is not at the first position P1.

The control unit 13 may detect a switching failure of the second four-way valve 18 as follows. When the second four-way valve 18 is at the first position P1, the high-pressure refrigerant discharged from the first compressor 2 does not enter the suction port of the second compressor 2. At this time, a temperature converted from the suction pressure of the second compressor 2 into a saturation temperature is equivalent to an outside air temperature. The control unit 13 receives a suction pressure signal output from the suction pressure sensor 15 of the second compressor 2. The control unit 13 receives an outside air temperature signal output from the outside air temperature sensor 17 of the second outdoor unit 12. When a difference between the temperature converted from the suction pressure into the saturation temperature and the outside air temperature is lower than a predetermined value, the control unit 13 determines that the second four-way valve 18 is at the first position P1. Conversely, when the difference between the temperature converted from the suction pressure into the saturation temperature and the outside air temperature is equal to or larger than the predetermined value, the control unit 13 determines that the second four-way valve 18 is not at the first position P1.

Similarly, the control unit 13 may determine that the second four-way valve 18 is not at the first position P1 on the basis of an output signal of the pressure sensor and an output signal of the temperature sensor. The pressure sensor is at least one of the discharge pressure sensor 14 of the second compressor 2 and the suction pressure sensor 15 of the second compressor 2. The temperature sensor is at least one of the suction temperature sensor 16 of the second compressor 2 and the outside air temperature sensor 17 of the second outdoor unit 12.

When the second four-way valve 18 is not at the first position P1, the control unit 13 moves the second four-way valve 18 to the first position P1 as follows.

First, the control unit 13 turns off energization to the solenoid 31 of the second four-way valve 18 illustrated in FIG. 5. As illustrated in FIG. 3, the main valve body 28 is still disposed at the second position P2 immediately after the sub-valve body 33 has moved to the fourth position P4. As illustrated in FIG. 4, when the second four-way valve 18 is at the second position P2, the high-pressure refrigerant discharged from the first compressor 2 flows into the fourth port 24 from the second port 22 of the second four-way valve 18. The high-pressure refrigerant flows into the first cylinder chamber 26 via the capillary 24*t*, the eighth port 38, the sixth port 36, and the capillary 26*t* illustrated in FIG. 3. On the other hand, since the high-pressure refrigerant does not flow into the first port 21 of the second four-way valve 18, the second cylinder chamber 27 is at a low pressure. The first cylinder chamber 26 expands and the second cylinder chamber 27 contracts. Thereby, the main valve body 28 of the second four-way valve 18 moves to the first position P1 as illustrated in a fourth operation explanatory view of the four-way valve in FIG. 6.

As illustrated in FIG. 1, when the second four-way valve 18 is at the first position P1, the high-pressure refrigerant discharged from the first compressor 2 flows from the second port 22 of the second four-way valve 18 into the first port 21. The high-pressure refrigerant flows into the second cylinder chamber 27 via the capillary 21*t*, the fifth port 35, the seventh port 37, and the capillary 27*t* illustrated in FIG. 6. On the other hand, since the high-pressure refrigerant does not flow into the fourth port 24 of the second four-way valve 18, the first cylinder chamber 26 is at a low pressure. The second cylinder chamber 27 expands and the first cylinder chamber 26 contracts. Thereby, the main valve body 28 of the second four-way valve 18 returns to the second position P2 as illustrated in FIG. 3. When energization to the solenoid 31 of the second four-way valve 18 is kept off, the main valve body 28 repeats reciprocating movement between the first position P1 and the second position P2.

Figure 6:
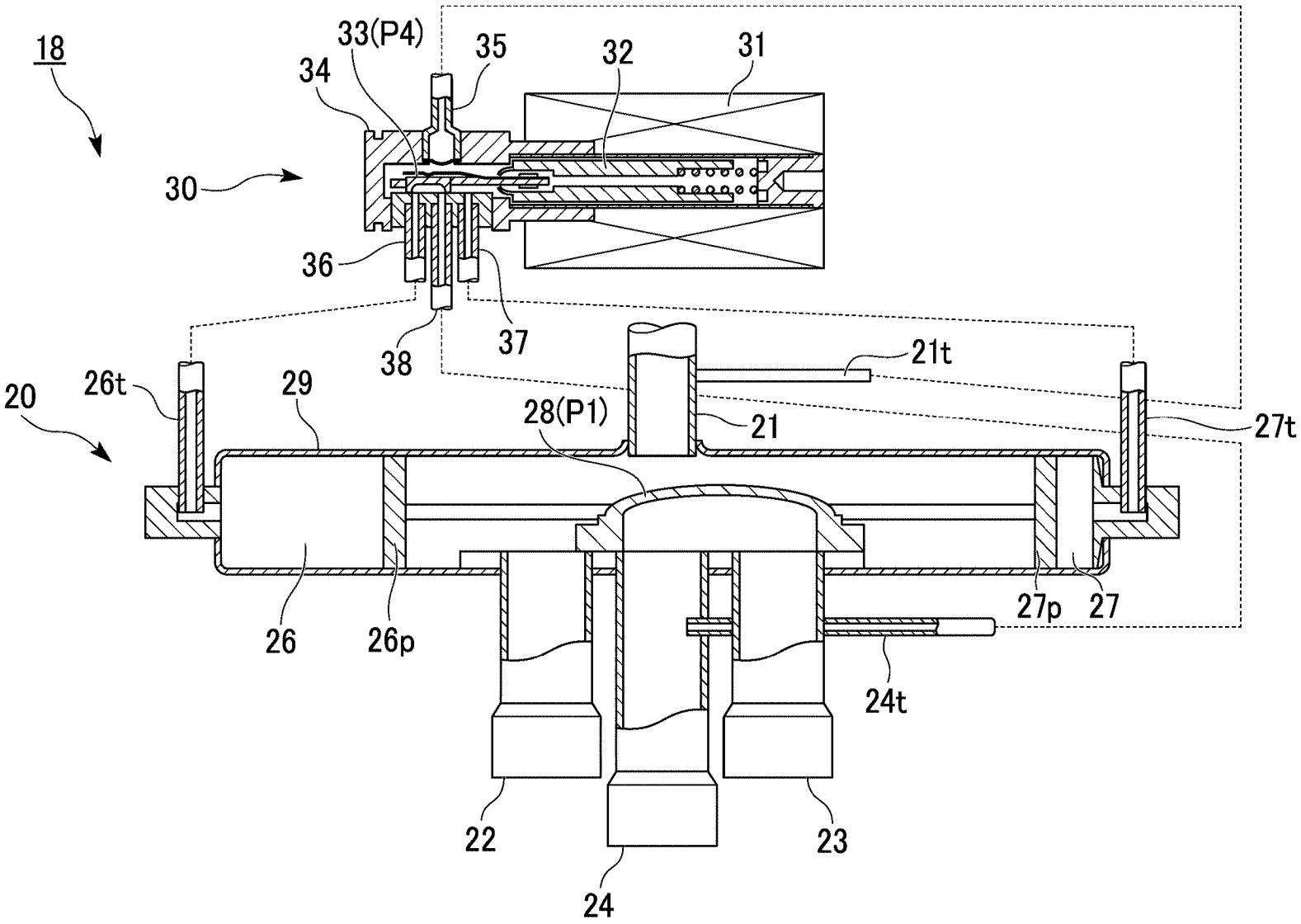
FIG. 6 is a fourth operation explanatory view of the four-way valve.

After the main valve body 28 of the second four-way valve 18 has moved to the first position P1, the control unit 13 turns on energization to the solenoid 31 as illustrated in FIG. 6. The sub-valve body 33 moves to the third position P3 as illustrated in FIG. 2. That is, the control unit 13 disposes the sub-valve body 33 at the fourth position and then moves the sub-valve body 33 to the third position. As illustrated in FIG. 1, when the second four-way valve 18 is at the first position P1, the high-pressure refrigerant discharged from the first compressor 2 flows from the second port 22 of the second four-way valve 18 to the first port 21. The high-pressure refrigerant flows into the first cylinder chamber 26 via the capillary 21*t*, the fifth port 35, the sixth port 36, and the capillary 26*t* illustrated in FIG. 2. On the other hand, since the high-pressure refrigerant does not flow into the fourth port 24, the second cylinder chamber 27 is at a low pressure. The first cylinder chamber 26 is maintained in an expanded state, and the second cylinder chamber 27 is maintained in a contracted state. Thereby, the main valve body 28 of the second four-way valve 18 is held at the first position P1.

Figure 7:
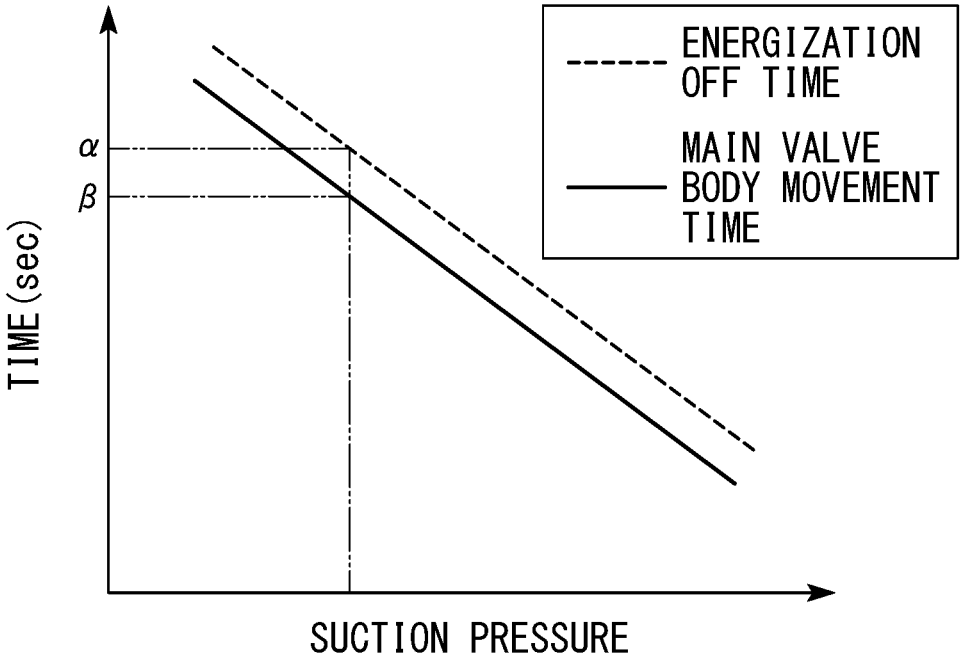
FIG. 7 is a graph showing a relationship between a suction pressure of a compressor and a switching time of the four-way valve.

FIG. 7 is a graph showing a relationship between a suction pressure of the compressor and a switching time of the four-way valve. As described above, the control unit 13 turns on energization to the solenoid 31 after the main valve body 28 of the second four-way valve 18 has moved to the first position P1. As described above, movement of the main valve body 28 to the first position P1 is caused by a pressure of the refrigerant discharged from the first compressor 2 and flowed into the fourth port 24 of the second four-way valve 18. A pressure at the fourth port 24 of the second four-way valve 18 is the suction pressure of the second compressor 2. As illustrated in FIG. 7, the time (indicated by the solid line in FIG. 7) required for the main valve body 28 to move from the second position P2 to the first position P1 becomes shorter as the suction pressure increases.

The control unit 13 sets a time required from when the sub-valve body 33 is disposed at the fourth position P4 to when it is moved to the third position P3 on the basis of the suction pressure signal. The time required from when the sub-valve body 33 is disposed at the fourth position P4 to when it is moved to the third position P3 is a time (indicated by the broken line in FIG. 7) during which energization to the solenoid 31 is OFF. As illustrated in FIG. 7, the control unit 13 shortens the energization OFF time to the solenoid 31 as the suction pressure is higher. The control unit 13 makes an energization OFF time a to the solenoid 31 longer than a movement time 13 of the main valve body 28. The control unit 13 turns on energization to the solenoid 31 after the energization OFF time to the solenoid 31 has elapsed. Thereby, energization to the solenoid 31 is turned on immediately after the main valve body 28 moves to the first position P1, and the second four-way valve 18 is held at the first position P1.

After the sub-valve body 33 is disposed at the fourth position P4 and then moved to the third position P3, the control unit 13 re-inspects the switching failure of the second four-way valve 18. As a result of the reinspection, when the second four-way valve 18 is not at the first position P1, the control unit 13 stops the refrigeration cycle device 1. The control unit 13 may stop the refrigeration cycle device 1 when the second four-way valve 18 is not at the first position P1 after repeating movement of the sub-valve body 33 a plurality of times. When the movement time of the main valve body 28 and the energization OFF time to the solenoid 31 illustrated in FIG. 7 are not appropriately set, it is considered that the second four-way valve 18 is not disposed at the first position P1. In this case, a failure of the refrigeration cycle device 1 is suppressed by stopping the first outdoor unit 11 that was scheduled to operate.

As detailed above, the refrigeration cycle device 1 of the embodiment includes the indoor unit 10, the first outdoor unit 11 and the second outdoor unit 12, and the control unit 13. The indoor unit 10 includes the indoor heat exchanger 4. The first outdoor unit 11 and the second outdoor unit 12 are connected in parallel to the indoor unit 10. The second outdoor unit 12 includes the compressor 2, the outdoor heat exchanger 8, and the four-way valve 18. The four-way valve 18 switches a supply destination of the refrigerant discharged from the compressor 2 between the indoor heat exchanger 4 and the outdoor heat exchanger 8. The four-way valve 18 includes the main valve 20 having the main valve body 28 and the sub-valve 30 having the sub-valve body 33. The main valve body 28 is movable between the first position P1 and the second position P2. The first position P1 is a position that allows the refrigerant discharged from the compressor 2 to be supplied to one of the indoor heat exchanger 4 and the outdoor heat exchanger 8. The second position P2 is a position that allows the refrigerant discharged from the compressor 2 to be supplied to the other of the indoor heat exchanger 4 and the outdoor heat exchanger 8. The sub-valve body 33 is driven by the solenoid 31 and is movable between the third position P3 and the fourth position P4. The third position P3 is a position that causes the main valve body 28 to be disposed at the first position P1. The fourth position P4 is a position that causes the main valve body 28 to be disposed at the second position P2. In case in which the first outdoor unit 11 is operated and the second outdoor unit 12 is stopped, when the main valve body 28 is not at the first position P1, the control unit 13 disposes the sub-valve body 33 at the fourth position P4 and then moves the sub-valve body 33 to the third position P3.

The main valve 20 includes the first port 21 connected to the discharge port of the compressor 2. The main valve 20 includes the second port 22 connected to one of the indoor heat exchanger 4 and the outdoor heat exchanger 8. The main valve 20 includes the third port 23 connected to the other of indoor heat exchanger 4 and the outdoor heat exchanger 8. The main valve 20 includes the fourth port 24 connected to the suction port of the compressor 2. The main valve 20 includes the first cylinder chamber 26 that expands to move the main valve body 28 to the first position P1. The main valve 20 includes the second cylinder chamber 27 that expands to move the main valve body 28 to the second position P2.

The main valve body 28 connects the first port 21 and the second port 22 and connects the third port 23 and the fourth port 24 when it is at the first position P1. The main valve body 28 connects the first port 21 and the third port 23 and connects the second port 22 and the fourth port 24 when it is at the second position P2.

The sub-valve 30 includes the fifth port 35 communicating with the first port 21. The sub-valve 30 includes the sixth port 36 connected to the first cylinder chamber 26. The sub-valve 30 includes the seventh port 37 connected to the second cylinder chamber 27. The sub-valve 30 includes the eighth port 38 communicating with the fourth port 24.

The sub-valve body 33 connects the fifth port 35 and the sixth port 36 and connects the seventh port 37 and the eighth port 38 when it is at the third position P3. The sub-valve body 33 connects the fifth port 35 and the seventh port 37 and connects the sixth port 36 and the eighth port 38 when it is at the fourth position P4.

When the sub-valve body 33 is disposed at the fourth position P4, the main valve body 28 moves to the first position P1. Thereafter, when the sub-valve body 33 is moved to the third position P3, the main valve body 28 is held at the first position P1. Thereby, a switching failure of the four-way valve 18 in the second outdoor unit 12 that is stopped can be eliminated.

The second outdoor unit 12 includes the suction pressure sensor 15 that outputs a suction pressure signal corresponding to the suction pressure of the compressor 2. The control unit 13 sets a time required from when the sub-valve body 33 is disposed at the fourth position P4 to when it is moved to the third position P3 on the basis of the suction pressure signal.

The time until the main valve body 28 moves to the first position P1 changes according to the suction pressure of the compressor 2 of the second outdoor unit 12 that is stopped. The control unit 13 sets a time required from when the sub-valve body 33 is disposed at the fourth position P4 to when it is moved to the third position P3 on the basis of the suction pressure signal received from the suction pressure sensor 15. Thereby, after the main valve body 28 has moved to the first position P1, the sub-valve body 33 is disposed at the third position P3, and the main valve body 28 is held at the first position P1.

The first outdoor unit 11 includes the discharge pressure sensor 14 that outputs a discharge pressure signal corresponding to the discharge pressure of the compressor 2 of the first outdoor unit 11. The second outdoor unit 12 includes the suction pressure sensor 15 that outputs a suction pressure signal corresponding to the suction pressure of the compressor 2 of the second outdoor unit 12. The control unit 13 determines that the main valve body 28 is not at the first position P1 when a difference between the discharge pressure and the suction pressure is lower than a predetermined value.

When the main valve body 28 is not at the first position P1, the high-pressure refrigerant discharged from the first compressor 2 of the first outdoor unit 11 enters the suction port of the second compressor 2 of the second outdoor unit 12. When a difference between the discharge pressure of the first compressor 2 and the suction pressure of the second compressor 2 is lower than the predetermined value, it can be determined that the main valve body 28 is not at the first position P1.

The second outdoor unit 12 includes a pressure sensor and a temperature sensor. The pressure sensor is at least one of the discharge pressure sensor 14 of the compressor 2 and the suction pressure sensor 15 of the compressor 2. The temperature sensor is at least one of the suction temperature sensor 16 of the compressor 2 and the outside air temperature sensor 17. The control unit 13 determines that the main valve body 28 is not at the first position P1 on the basis of the output signal of the pressure sensor and the output signal of the temperature sensor.

When the main valve body 28 is at the first position P1, the high-pressure refrigerant discharged from the first compressor 2 does not enter the suction port of the second compressor 2. At this time, a temperature converted from the suction pressure of the second compressor 2 into a saturation temperature is equivalent to an outside air temperature. On the basis of the output signal of the pressure sensor and the output signal of the temperature sensor, it can be determined that the main valve body 28 is not at the first position P1.

The control unit 13 stops the first outdoor unit 11 when the main valve body 28 is not at the first position P1 after the sub-valve body 33 is disposed at the fourth position P4 and then moved to the third position P3.

Thereby, a failure of the refrigeration cycle device 1 is suppressed.

According to at least one embodiment described above, the control unit 13 configured to dispose the sub-valve body 33 at the fourth position P4 and then move the sub-valve body 33 to the third position P3 is provided. Thereby, a switching failure of the four-way valve 18 in the second outdoor unit 12 that is stopped can be eliminated.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A refrigeration cycle device comprising:

an indoor unit including an indoor heat exchanger;

a first outdoor unit and a second outdoor unit connected in parallel to the indoor unit; and a control unit, wherein the first outdoor unit includes a first compressor, a first outdoor heat exchanger, and a first four-way valve which switches a supply destination of a refrigerant discharged from the first compressor between the indoor heat exchanger and the first outdoor heat exchanger, the first four-way valve includes a first main valve having a first main valve body and a first sub-valve having a first sub-valve body, the first main valve body is movable between a first position which allows the refrigerant discharged from the first compressor to be supplied to the indoor heat exchanger and a second position which allows the refrigerant discharged from the first compressor to be supplied to the first outdoor heat exchanger, the first sub-valve body is driven by a first solenoid, and is movable between a third position which causes the first main valve body to be disposed at the first position and a fourth position which causes the first main valve body to be disposed at the second position, the second outdoor unit includes a second compressor, a second outdoor heat exchanger, and a second four-way valve which switches a supply destination of a refrigerant discharged from the second compressor between the indoor heat exchanger and the second outdoor heat exchanger, the second four-way valve includes a second main valve having a second main valve body and a second sub-valve having a second sub-valve body, the second main valve body is movable between a first position which allows the refrigerant discharged from the second compressor to be supplied to the indoor heat exchanger and a second position which allows the refrigerant discharged from the second compressor to be supplied to the second outdoor heat exchanger, the second sub-valve body is driven by a second solenoid, and is movable between a third position which causes the second main valve body to be disposed at the first position and a fourth position which causes the second main valve body to be disposed at the second position, and the control unit disposes the second sub-valve body of the second outdoor unit at the fourth position and then moves the second sub-valve body of the second outdoor unit to the third position when the first main valve body of the first four-way valve of the first outdoor unit is at the first position and the second main valve body of the second four-way valve of the second outdoor unit is not at the first position in a case in which the first outdoor unit is operated and the second outdoor unit is stopped.

2. The refrigeration cycle device according to claim 1, wherein the first main valve includes:

a first port connected to a discharge port of the first compressor;

a second port connected to the indoor heat exchanger;

a third port connected to the first outdoor heat exchanger;

a fourth port connected to a suction port of the first compressor;

a first cylinder chamber expanding to move the first main valve body to the first position; and a second cylinder chamber expanding to move the first main valve body to the second position, the first main valve body connects the first port and the second port of the first main valve and connects the third port and the fourth port of the first main valve when it is at the first position, and connects the first port and the third port of the first main valve and connects the second port and the fourth port of the first main valve when it is at the second position, the first sub-valve includes:

a fifth port communicating with the first port of the first main valve;

a sixth port connected to the first cylinder chamber of the first main valve;

a seventh port connected to the second cylinder chamber of the first main valve; and an eighth port communicating with the fourth port of the first main valve, and the first sub-valve body connects the fifth port and the sixth port of the first sub-valve and connects the seventh port and the eighth port of the first sub-valve when it is at the third position, and connects the fifth port and the seventh port of the first sub-valve and connects the sixth port and the eighth port of the first sub-valve when it is at the fourth position, the second main valve includes:

a first port connected to a discharge port of the second compressor:

a second port connected to the indoor heat exchanger;

a third port connected to the second outdoor heat exchanger;

a fourth port connected to a suction port of the second compressor;

a first cylinder chamber expanding to move the second main valve body to the first position; and a second cylinder chamber expanding to move the second main valve body to the second position, the second main valve body connects the first port and the second port of the second main valve and connects the third port and the fourth port of the second main valve when it is at the first position, and connects the first port and the third port of the second main valve and connects the second port and the fourth port of the second main valve when it is at the second position, the second sub-valve includes:

a fifth port communicating with the first port of the second main valve;

a sixth port connected to the first cylinder chamber of the second main valve;

a seventh port connected to the second cylinder chamber of the second main valve;

an eighth port communicating with the fourth port of the second main valve, and the second sub-valve body connects the fifth port and the sixth port of the second sub- valve and connects the seventh port and the eighth port of the second sub-valve when it is at the third position, and connects the fifth port and the seventh port of the second sub-valve and connects the sixth port and the eighth port of the second sub-valve when it is at the fourth position.

3. The refrigeration cycle device according to claim 1, wherein the second outdoor unit includes a suction pressure sensor which outputs a suction pressure signal corresponding to a suction pressure of the second compressor of the second outdoor unit, and the control unit sets a time required from when the second sub-valve body of the second outdoor unit is disposed at the fourth position to when it is moved to the third position on the basis of the suction pressure signal.

4. The refrigeration cycle device according to claim 1, wherein the first outdoor unit includes a discharge pressure sensor which outputs a discharge pressure signal corresponding to a discharge pressure of the first compressor of the first outdoor unit, the second outdoor unit includes a suction pressure sensor which outputs a suction pressure signal corresponding to a suction pressure of the second compressor of the second outdoor unit, and the control unit determines that the second main valve body of the second four-way valve of the second outdoor unit is not at the first position when a difference between the discharge pressure and the suction pressure is lower than a predetermined value.

5. The refrigeration cycle device according to claim 1, wherein the second outdoor unit includes a pressure sensor and a temperature sensor, the pressure sensor is at least one of a discharge pressure sensor of the second compressor of the second outdoor unit and a suction pressure sensor of the second compressor of the second outdoor unit, the temperature sensor is at least one of a suction temperature sensor of the second compressor and an outside air temperature sensor in the second outdoor unit, and the control unit determines that the second main valve body of the second four-way valve of the second outdoor unit is not at the first position on the basis of an output signal of the pressure sensor and an output signal of the temperature sensor.

6. The refrigeration cycle device according to claim 1, wherein the control unit stops the first outdoor unit when the second main valve body of the second four-way valve of the second outdoor unit is not at the first position after the second sub-valve body of the second outdoor unit is disposed at the fourth position and then moved to the third position.

* * * * *